US007365286B2

(12) United States Patent
Creteau et al.

(10) Patent No.: US 7,365,286 B2
(45) Date of Patent: Apr. 29, 2008

(54) HEATER ASSEMBLY INCLUDING HOUSING WITH STRAIN RELIEF FEATURES

(75) Inventors: Gregory Daniel Creteau, Winchester, KY (US); Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/421,785

(22) Filed: Jun. 2, 2006

(65) Prior Publication Data

US 2007/0278203 A1 Dec. 6, 2007

(51) Int. Cl.
*G03G 15/20* (2006.01)
*H05B 3/06* (2006.01)
*H05B 3/08* (2006.01)

(52) U.S. Cl. ..... 219/216; 219/541

(58) Field of Classification Search ..... None
See application file for complete search history.

(56) References Cited

U.S. PATENT DOCUMENTS 1,646,038 A * 10/1927 Miller ..... 219/541
4,029,896 A * 6/1977 Skinner ..... 219/541
5,359,179 A * 10/1994 Desloge et al. ..... 219/541
6,252,207 B1 * 6/2001 Cahill et al. ..... 219/216
6,646,227 B2 * 11/2003 Yura et al. ..... 219/216

* cited by examiner

*Primary Examiner*—J. Pelham
(74) *Attorney, Agent, or Firm*—Grossman, Tucker, Perreault & Pfleger PLLC

(57) ABSTRACT

A heater assembly includes a heater housing with strain relief features for wires associated with electronic components, such as a thermistor and/or thermal cut-off (TCO) device, coupled to a heating element. The heater assembly may be used in a fixing device or fuser in an image forming apparatus including, but not limited to, printers, copiers, faxes, multifunctional devices or all-in-one devices.

23 Claims, 4 Drawing Sheets

HEATER ASSEMBLY INCLUDING HOUSING WITH STRAIN RELIEF FEATURES

BACKGROUND

Technical Field

The present invention relates to heater assemblies for use in an image forming apparatus, and more particularly, to a heater assembly including a heater housing with strain relief features to provide strain relief for wires associated with an electronic component, such as a thermistor and/or thermal cut-off (TCO) device, coupled to the heater.

An image forming apparatus may incorporate a fixing device, such as a fuser, for fixing toner or other image forming substances to media. The fixing device may include a heating device, for example, a belt fusing system or a hot roll system, which applies heat and/or pressure to the image fixing substance on the media. The heating device may include a heating element formed by a substrate with a resistive heating element on a surface thereof. The fixing device may also include a backup roll in cooperation with the heating device to form a nip through which the media passes.

The temperature of the heating element may be monitored with a thermistor mounted to the heating element. The heating element may be switched on and off in response to the thermistor to achieve a desired thermal condition (e.g., a temperature that fuses toner). A thermal cut-off (TCO) device may also be used to cut off current to the heating element in the event of a thermal runaway condition (e.g., if the heater is not switched off in response to the thermistor).

Both the thermistor and the TCO device may be coupled to the heating element and attached to wires that provide current. The wires should be arranged to comply with applicable safety regulations and should be strain relieved to prevent the wires from disconnecting. Existing heater assemblies may include multiple separate strain relief housings that are movable relative to the heater housing to organize the wires and provide strain relief. Such existing assemblies are complicated, and excessive movement may cause connector problems within the heater assembly.

SUMMARY

One exemplary embodiment consistent with the present invention relates to a heater housing for use in a heater assembly in an image forming apparatus. The heater housing includes a housing body having a first side and a second side. The first side of the housing body includes a heater receiving region configured to receive a heating element. The second side of the housing includes at least one wire receiving region configured to receive wires associated with at least one electronic component coupled to the heating element. The heater housing further includes at least one wire strain relief structure integral with the housing body and extending from the second side of the housing body and configured to route the wires along the wire receiving region.

Another exemplary embodiment consistent with the present invention relates to a heater assembly. The heater assembly includes a heater housing including a housing body having a first side and a second side and at least one wire strain relief structure integral with the housing body and extending from the second side of the housing body. The heater assembly further includes a heating element located in a heater receiving region on the first side of the housing body and at least one wire associated with an electronic component coupled to the heating element. The at least one wire passes along the second side of the housing body in a wire receiving region and around the at least one wire strain relief structure.

A further exemplary embodiment consistent with the present invention relates to a fuser for use in an image forming apparatus. The fuser includes a heater assembly as described above, a rotatable heat transfer member around the heater assembly, and a backup member in contact with the rotatable heat transfer member to form a nip. The backup member contacts the rotatable heat transfer member in a region opposite the heating element.

BRIEF DESCRIPTION OF DRAWINGS

The detailed description below may be better understood with reference to the accompanying figures which are provided for illustrative purposes and are not to be considered as limiting any aspect of the invention.

DETAILED DESCRIPTION

The present invention relates to a heater assembly including a heater housing with strain relief features for wires associated with electronic components, such as a thermistor and/or thermal cut-off (TCO) device, that are coupled to a heating element. The heater assembly may be used in an image forming apparatus including, but not limited to, printers, copiers, faxes, multifunctional devices or all-in-one devices. An image forming apparatus may incorporate a fixing device, such as a fuser or another device, which may include the heater assembly and may transfer heat or thermal energy from within the image forming apparatus.

Figure 1:
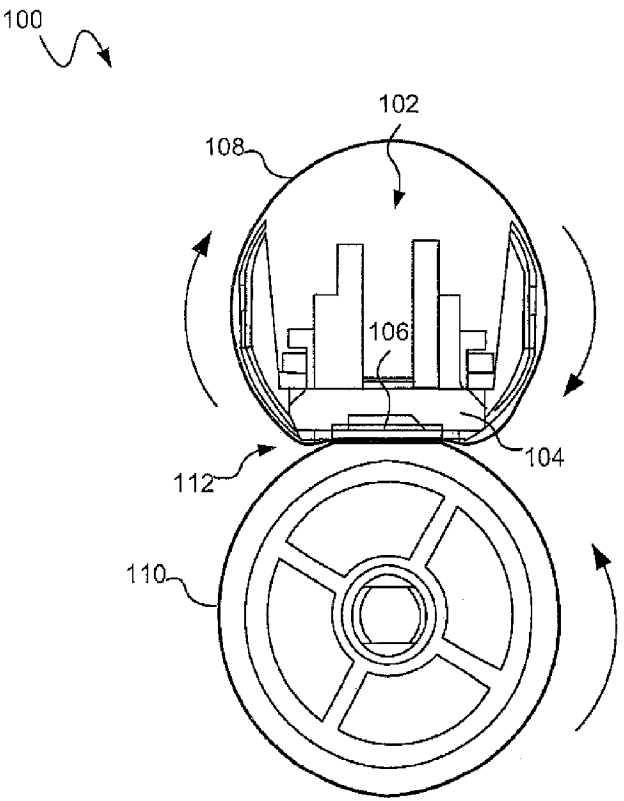
FIG. 1 is a side view of a fixing device including a heater assembly, consistent with one embodiment of the present invention.
Figure 2:
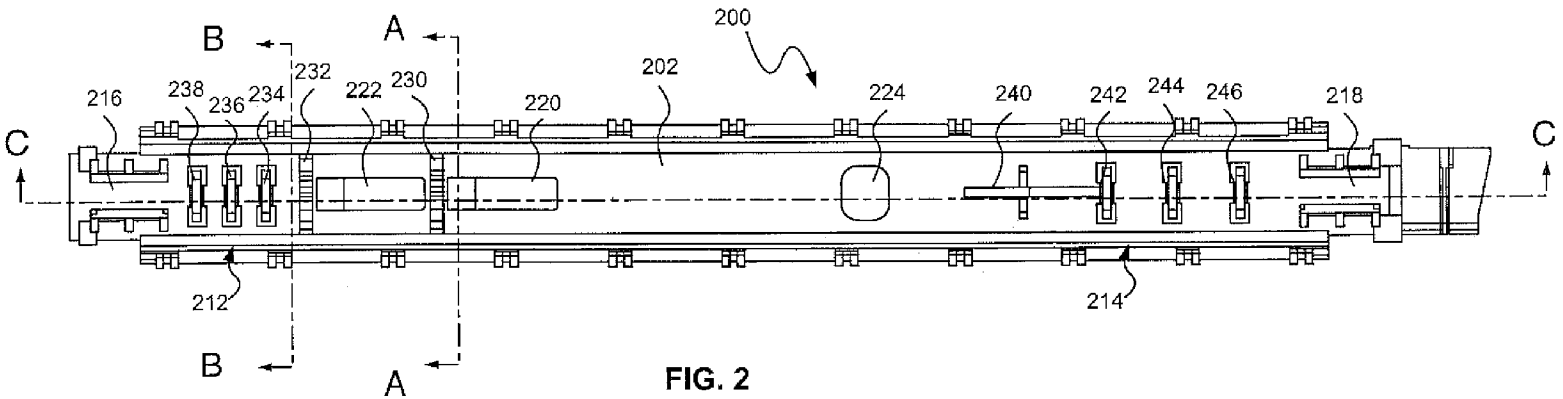
FIG. 2 is a top view of a heater housing, consistent with one embodiment of the present invention.
Figure 2B:
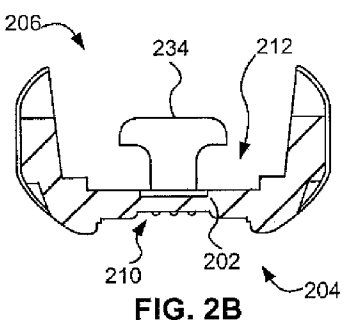
FIG. 2B is a cross-sectional view of the heater housing taken along line B-B in FIG. 2
Figure 2A:
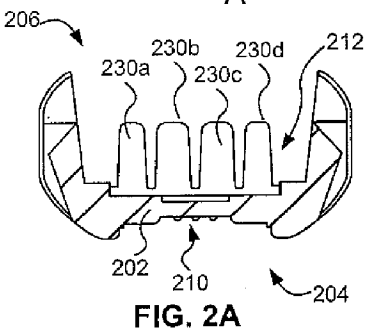
FIG. 2A is a cross-sectional view of the heater housing taken along line A-A in FIG. 2.
Figure 2C:
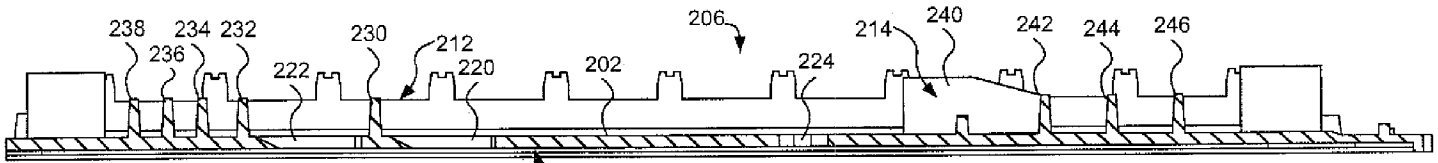
FIG. 2C is a cross-sectional view of the heater housing taken along line C-C in FIG. 2

FIG. 1 illustrates an exemplary fixing device or fuser 100 including a heater assembly 102, consistent with one embodiment of the present invention. The fixing device 100 may be used to fix toner or other image forming substances to media (e.g., paper) through the application of heat and/or pressure. The heater assembly 102 may include a heater housing 104 and a heating element 106 that is capable of providing a temperature adequate for fusing toner or other image forming substances. The heating element 106 may include, for example, ceramic heating elements or heating lamps. The fixing device 100 may also include a rotatable heat transfer member 108, such as a flexible belt or seamless tube, rotating about the heater assembly 102 to provide, for example, a heated roll or "belt heater assembly."

The fixing device 100 may also include a backup member 110, such as a roll, that causes the rotatable heat transfer member 108 to rotate around the heater assembly 102. Pressure may be applied between the backup member 110 and the rotatable heat transfer member 108 to form a nip 112 through which media may pass. As media enters the nip 112, energy may pass from the heating element 106 through the rotatable heat transfer member 108, through the media, and through the backup member 110. Those skilled in the art will recognize that the fixing device may have other configurations and may include other components.

Referring to FIGS. 2 and 2A-2C, one embodiment of a heater housing 200 is described in greater detail. The heater housing 200 may include a housing body 202 having a first side 204 and a second side 206. The housing body 202 may be made of a plastic material, such as a thermotropic liquid crystal polymer (LCP), or other suitable material. The first side 204 of the housing body 202 may define a heater receiving region 210 and the second side 206 of the housing body 202 may define one or more wire receiving regions 212, 214. As will be described in greater detail below, the heater receiving region 210 may be configured to receive one or more heating elements (not shown) and the wire receiving region(s) 212, 214 may be configured to receive one or more wires associated with electronic components coupled to the heating element. The housing body 202 may also define one or more apertures 220, 222, 224 that allow access to a heating element from the second side 206 of the housing body 202.

In one embodiment, the second side 206 of the housing body 202 defines first and second wire receiving regions 212, 214 longitudinally separated on the housing body 202. For example, the first wire receiving region 212 may extend along one end of the housing body 202 and the second wire receiving region 214 may extend along the other end of the housing body 202. The housing body 202 may also define channels 216, 218 at each end of the housing body 202 through which the wires may pass into the respective wire receiving regions 212, 214.

The wire receiving regions 212, 214 may include one or more structures 230, 232, 234, 236, 238, 240, 242, 244, 246 integral with the housing body 202 and extending from the second side 206 of the housing body 202 for routing and/or separating the wires passing along the second side 206 of the housing body 202. A structure that is integral with the housing body 202 may be understood as a structure that does not rely upon mechanical engagement to the housing body. Such a structure may include one that does not move relative to the housing body 202 at the point of attachment to the housing body 202. Such movement may be due to the influence of stress imposed by the routed wires or vibrations created by other moving components in the image forming apparatus. The structures 230, 232, 234, 236, 238, 240, 242, 244, 246 may therefore be formed integral with the housing body 202 by molding the structures directly into the heater housing 200 as one-piece (i.e. unitary construction) with the housing body 202. Alternatively, the structures 230, 232, 234, 236, 238, 240, 242, 244, 246 may also be formed integral with the housing body 202 by fusing, plastic welding, adhering, or other such techniques known to those skilled in the art that provide the above referenced feature that at the point of attachment to the housing body, there is no movement when under the influence of stress by the wires or vibrations created by other moving components in the image forming apparatus.

In one embodiment, the first wire receiving region 212 may include one or more strain relief structures 230, 232, 234, 236, 238 that route the wires to provide strain relief such that at least a portion of a force applied to the wires is taken up by the strain relief structures 230, 232, 234, 236, 238. According to one embodiment, strain relief structures 230 may include a plurality of posts 230*a*-230*d* (see FIG. 2A) spaced laterally across the housing body 202 such that wires may be routed in the spaces between the posts 230*a*-230*d*. According to another embodiment, strain relief structures 234, 236, 238 may include a series of posts paced longitudinally along the housing body 202 such that wires may be routed around the strain relief structures 234, 236, 238. The strain relief structures 234, 236, 238 may be formed as posts with a generally "T" shape (see FIG. 2B).

In one embodiment, the second wire receiving region 214 may include a spacer 240 and one or more strain relief structures 242, 244, 246. The spacer 240 may extend longitudinally along the housing body 202 such that wires may extend along each side of the spacer 240. The strain relief structures 242, 244, 246 may be posts (e.g., T-shaped posts) spaced longitudinally on the housing body 202 to route the wires around the structures 242, 244, 246 such that at least a portion of a force applied to the wires is taken up by the strain relief structures 242, 244, 246.

Those skilled in the art will recognize that the structures 230, 232, 234, 236, 238, 240, 242, 244, 246 may have other configurations. The structures 230, 232, 234, 236, 238, 240, 242, 244, 246 may, for example, have other shapes or may be spaced differently. The housing 200 may also have a different number of structures than shown in the exemplary embodiment.

Figure 3:
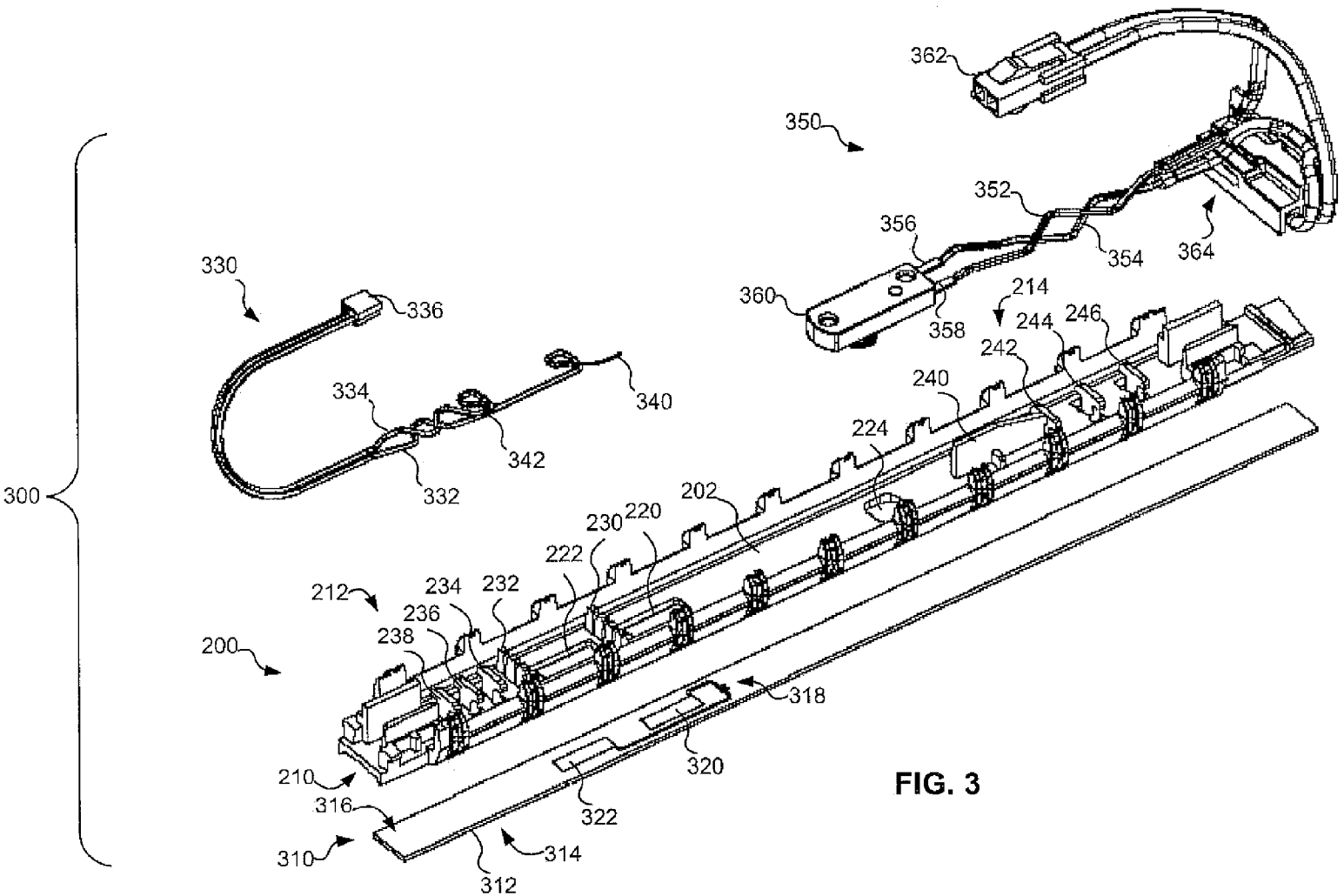
FIG. 3 is a perspective view of a heater assembly, consistent with one embodiment of the present invention.
Figure 4:
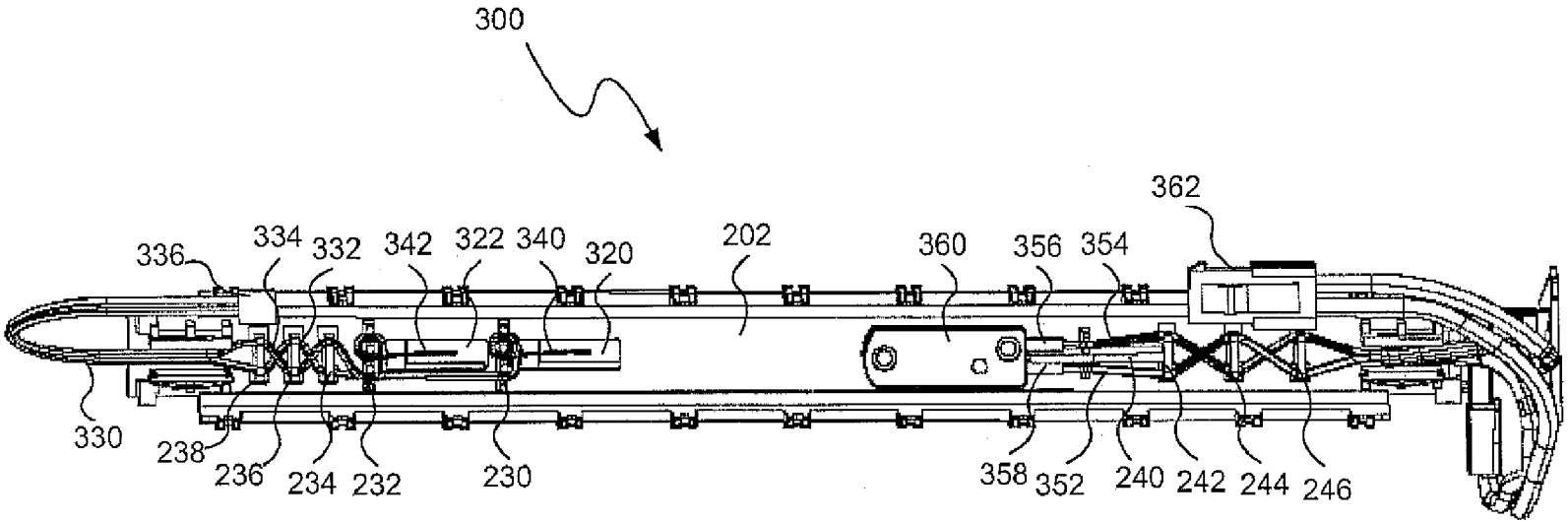
FIG. 4 is a top view of the heater assembly shown in FIG. 3.

Referring to FIGS. 3 and 4, one embodiment of a heater assembly 300 is shown in greater detail. The heater assembly 300 may include the heater housing 200, a heating element 310 on the first side of the heater housing 200, and one or more wire assemblies 330, 350 on the second side of the heater housing 200. The heating element 310 may be positioned in the heater receiving region 210 of the heater housing 200 and may be secured, for example, using a silicone adhesive. The wire assemblies 330, 350 may be positioned in the wire receiving regions 212, 214 of the heater housing 200 and secured with one or more of the structures 230, 232, 234, 236, 238, 240, 242, 244, 246.

One embodiment of the heating element 310 may include a substrate 312 having a resistive heating element formed on a front side 314 thereof. The front side 314 of the heating element 310 may also include AC power conductors (not shown) to provide current to the resistive heating element. The substrate 312 may be a long, relatively thin ceramic (e.g., aluminum oxide or aluminum nitride) substrate onto which conductive and resistive lands may be printed, dried and fired to form the resistive heating element. The substrate 312 may be covered by a glass powder frit material and fired again to form a smooth electrically insulated surface. Such a heating element may be referred to as a "heater slab." Those skilled in the art will recognize that multiple heating elements may be used and other types of heating elements may be used.

The heating element 310 may also include a thermistor 318 mounted on the back side 316 of the substrate 312, for example, using an electrically conductive adhesive. The thermistor 318 may be a chip thermistor of the type known to those skilled in the art and may be capable of providing output ranges from approximately 360 kilo-ohms at room temperature to about 2.4 kilo-ohms at 250° C. The thermistor 318 may use a thermistor circuit signal that is a resultant DC voltage when the thermistor circuit is supplied with 5 volts DC. The thermistor 318 may be electrically connected to one or more conductors 320, 322, such as thick film conductor pads printed on the back side 316 of the heating element substrate 312.

According to one embodiment, wire assembly 330 may include thermistor wires 332, 334 configured to be coupled to the thermistor DC circuit and configured to carry a direct current. The thermistor wires 332, 334 may be coupled to a connector 336 at one end and may include exposed conductors 340, 342 at the other end. The electrical connector 336 may connect the thermistor wire assembly 330 (and thermistor circuit) to heater control hardware configured to control operation of the heater to achieve the appropriate temperature for fusing. The heater control hardware may include, for example, a triac or other switch used to switch the heater on and off in response to thermistor signals. The thermistor wire conductors 340, 342 may be electrically connected to the conductors 320, 322 on the heating element 310.

One method for electrically connecting the thermistor wire conductors 340, 342 to the conductors 320, 322 includes spot welding. The weld may be achieved, for example, using a high frequency inverter (e.g., 25 kHz) welder having closed loop digital control, parallel gap electrodes and a pneumatically or stepper motor controlled weld head. One example of such a welder includes a high frequency inverter power supply available under the name Miyachi Unitek Model HF 25 attached to an air actuated weld head equipped with two parallel gap electrodes available under the name Miyachi Unitek thin line 80 series. According to an exemplary welding procedure, a first pulse may be applied to act as a cleaning, preparatory pulse and a second pulse may be applied as the welding pulse.

Exemplary settings for the first pulse may include an up slope of 2.0 milliseconds (ms), a weld pulse of 3.0 ms, a down slope of 1.0 ms, and a constant power of 0.500 KW. Exemplary settings for the second pulse may include an up slope of 3.0 ms, a weld pulse of 2.0 ms, a down slope of 1.0 ms, and a constant power of 1.550 KW. The exemplary welder settings may also include a squeeze time of 750 ms and a time between pulses (i.e., cooling time) of about 8.0 ms. The welding yield may be controlled by setting the monitor limits to, for example, an upper limit for the first pulse of 0.600 KA, a lower limit for the first pulse of 0.300 KA, an upper limit for the second pulse of 0.900 KA, and a lower limit for the second pulse of 0.600 KA. The welder may be set to stop the pulse if the limits are not met. The weld head force may be set at 190-200 or approximately 15.1 lbs to 16.3 lbs. The spacing on the parallel gap electrodes may be set to a 0.25 mm gap between electrodes. The welding electrodes may be made of molybdenum or similar material and may have face dimensions of approximately 0.85 mm×1.25 mm. Those skilled in the art will recognize that other welding techniques and settings may be used.

When assembled, the conductors 320, 322 may be positioned in the respective apertures 220, 222 in the housing body 202 with the wire conductors 340, 342 attached thereto. The thermistor wires 332, 334 may be routed through spaces in the laterally spaced strain relief structures 230, 232, respectively, and around the longitudinally spaced strain relief structures 234, 236, 238. The wire 332, for example, may be routed through a space between the strain relief structures 230*b*, 230*c* (see FIG. 2A), through a space between the strain relief structures 230*c*, 230*d*, and then through a space between the strain relief structures 230*a*, 230*b*. The wire 332 may then be routed around each of the longitudinally spaced strain relief structures 234, 236, 238 crossing from one side to the other. The other wire 334 may be similarly routed through the laterally spaced strain relief structures 232 and around the longitudinally spaced strain relief structures 234, 236, 238. As a result, the structures 230, 232, 234, 236, 238 provide strain relief, for example, to prevent the conductor pads 320, 322 from detaching from the heating element substrate 312 and/or to prevent the wire conductors 340, 342 from detaching from the conductor pads 320, 322.

According to one embodiment, wire assembly 350 may include thermal cut-off (TCO) device wires 352, 354 configured to be coupled to the heater AC power circuit and configured to carry an alternating current. The TCO wires 352, 354 may be coupled to terminals 356, 358 of a TCO device 360 at one end and may be coupled to AC connectors 362 via a crimp connector 364 at the other end. The TCO device 360 is thus wired in series with the AC circuit providing current to the heating element 310. The TCO device 360 may be used to cut off current to the heating element 310 in the event of an over-temperature condition (e.g., if the tiac or switch in the heater control hardware fails). To couple the wires 352, 354 to the TCO device 360, conductors of the wires 352, 354 may be welded to the terminals 356, 358 of the TCO device 360. To couple the TCO device 360 to the heating element 310, the TCO device 360 may be seated in the heater housing 200 and applied directly to a surface of the heating element 310, for example, through the aperture 224. One embodiment of the TCO device 360 may include a bi-metal thermostat with a spring loaded coupling to the heating element 310.

When assembled, the TCO wires 352, 354 may pass on each side of the spacer 240 and may be routed around the longitudinally spaced strain relief structures 242, 244, 246. The spacer 240 may thus provide insulation between the terminals 356, 358 of the TCO device 360 and the wires 352, 354 coupled to the terminals 356, 358 of the TCO device 360. Each of the wires 352, 354 may then be routed around each of the longitudinally spaced strain relief structures 242, 244, 246 crossing from one side to the other. The strain relief structures 242, 244, 246 thus provide strain relief, for example, to prevent the wires 352, 354 from detaching from the TCO device 360.

The wire assemblies 330, 350 may thus be positioned on the heater housing 200 in compliance with applicable safety regulations, such as the UL 60950 standard published by Underwriters Laboratories and the IEC 60950 standard published by International Electrotechnical Commission (IEC). For example, the wire assemblies 330, 350 may be separated from each other on the heater housing 200 by at least about 5 mm. Although the exemplary embodiment includes thermistor and TCO wire assemblies 330, 350, those skilled in the art will recognize that other wire assemblies associated with other types of electronic components may be used.

Accordingly, the heater housing provides a simplified structure capable of both housing a heating element and providing strain relief for wires associated with electronic components coupled to the heating element.

The foregoing description is provided to illustrate and explain the present invention. However, the description hereinabove should not be considered to limit the scope of the invention set forth in the claims appended here to.

What is claimed is:

1. A heater housing for use in a heater assembly in an image forming apparatus, said heater housing comprising:

a housing body having a first side and a second side, said first side of said housing body including a heater receiving region configured to receive a heating element and said second side of said housing includes at least one wire receiving region configured to receive at least one wire associated with at least one electronic component coupled to the heating element; and at least one wire strain relief structure integral with said housing body and extending from said second side of said housing body, said at least one wire strain relief structure being configured to route the wires along said wire receiving region.

2. The heater housing of claim 1 wherein said at least one wire strain relief structure includes a plurality of posts.

3. The heater housing of claim 1 wherein said at least one wire strain relief structure is molded as one-piece with said housing body.

4. The heater housing of claim 1 further comprising at least one spacer integral with said housing body and extending from said second side of said housing body, said at least one spacer being configured to space at least two wires in said wire receiving region.

5. The heater housing of claim 1 wherein said housing body defines at least one aperture configured to provide access to the heating element from said second side of said housing body.

6. The heater housing of claim 1 wherein said at least one wire strain relief structure includes a plurality of posts spaced longitudinally along said housing body.

7. The heater housing of claim 1 wherein said at least one wire strain relief structure includes a plurality of posts spaced laterally across said housing body.

8. The heater housing of claim 1 wherein said second side of said housing body comprises a first wire receiving region extending along one end of said housing body and configured to receive at least a first wire associated with a first electronic component and a second wire receiving region extending along another end of said housing body and configured to receive at least a second wire associated with a second electronic component.

9. The heater housing of claim 8 wherein said at least one wire strain relief structure includes first and second wire strain relief structures in respective said first and second wire receiving regions.

10. The heater housing of claim 8 wherein said housing body defines first and second apertures in said first wire receiving region, and wherein said at least one wire strain relief structure includes at least a first wire strain relief structure proximate said first aperture and at least a second wire strain relief structure proximate said second aperture.

11. A heater assembly comprising:

a heater housing comprising:

a housing body having a first side and a second side, said first side of said housing body including a heater receiving region and said second side of said housing body including at least one wire receiving region; and at least one wire strain relief structure integral with said housing body and extending from said second side of said housing body;

a heating element located in said heater receiving region on said first side of said housing body; and at least one wire associated with an electronic component coupled to said heating element, said at least one wire passing along said second side of said housing body in said wire receiving region and around said at least one wire strain relief structure.

12. The heater assembly of claim 11 wherein said second side of said housing includes at least first and second wire receiving regions spaced longitudinally on said housing, and wherein said at least one wire includes at least one DC wire in said first wire receiving region and at least one AC wire in said second wire receiving region.

13. The heater assembly of claim 11 wherein said housing body defines at least one aperture, wherein at least one conductor on said heating element is exposed through said at least one aperture, and wherein said at least one wire on said second side of said housing body is welded to said at least one conductor.

14. The heater assembly of claim 11 wherein said housing body defines at least first and second apertures, and wherein said at least one wire includes at least one thermistor wire in said first wire receiving region and at least one thermal cut-off (TCO) wire in said second wire receiving region, said at least one thermistor wire being connected to a conductor on said heating element through said first aperture, and said TCO wire being connected to a TCO device coupled to said heating element through said second aperture.

15. The heater assembly of claim 14 wherein said at least one wire strain relief structure comprises a first group of posts configured to route said at least one thermistor wire.

16. The heater assembly of claim 15 wherein said at least one wire strain relief structure comprises a second group of posts configured to route said at least one TCO wire.

17. The heater assembly of claim 16 further comprising a spacer integral with said housing body and extending from said second side of said housing body, and wherein said at least one TCO wire includes at least first and second TCO wires on respective sides of said spacer.

18. The heater assembly of claim 11 wherein said at least one wire strain relief structure is molded as one-piece with said housing body.

19. A fuser for use in an image forming apparatus, comprising:

a heater assembly comprising:

a heater housing comprising a housing body having a first side and a second side, said first side of said housing body including a heater receiving region and said second side of said housing body including at least one wire receiving region, and at least one wire strain relief structure integral with said housing body and extending from said second side of said housing body;

a heating element located in said heater receiving region on said first side of said housing body; and at least one wire associated with an electronic component couple to said heating element, said at least one wire passing along said second side of said housing body in said wire receiving region and around said at least one wire strain relief structure;

a rotatable heat transfer member around said heater assembly; and a backup member in contact with said rotatable heat transfer member to form a nip, said backup member contacting said rotatable heat transfer member in a region opposite said heating element.

20. The fuser of claim 19 further comprising a thermistor and a thermal cut-off (TCO) device coupled to said heating element, said at least one wire including at least one thermistor wire coupled to said thermistor and at least one TCO wire coupled to said TCO device.

21. The fuser of claim 20 wherein said at least one strain relief structure includes a first group of posts extending from said housing body to route said at least one thermistor wire.

22. The fuser of claim 21 wherein said at least one strain relief structure includes a second group of posts extending from said housing body to route said at least one TCO wire.

23. The fuser of claim 22 further comprising a spacer integral with said housing body and extending from said second side of said housing body, and wherein said at least one TCO wire includes at least first and second TCO wires on respective sides of said spacer.

* * * * *